US007752702B2

(12) United States Patent
Nakamura et al.

(10) Patent No.: US 7,752,702 B2
(45) Date of Patent: Jul. 13, 2010

(54) BRUSH BRISTLE MATERIAL

(76) Inventors: Kenji Nakamura, 3-41, Nishiawaji 6-chome, Higashi Yodogawa-ku, Osaka-shi, Osaka (JP); Koji Nakamura, 3-41, Nishiawaji 6-chome, Higashi Yodogawa-ku, Osaka-shi, Osaka (JP)

( * ) Notice: Subject to any disclaimer, the term of this patent is extended or adjusted under 35 U.S.C. 154(b) by 1246 days.

(21) Appl. No.: 11/256,443

(22) Filed: Oct. 21, 2005

(65) Prior Publication Data

US 2006/0088711 A1 Apr. 27, 2006

(30) Foreign Application Priority Data

Oct. 21, 2004 (JP) ..... 2004-307223
Sep. 29, 2005 (JP) ..... 2005-284857

(51) Int. Cl.
*D02G 3/00* (2006.01)

(52) U.S. Cl. ..... 15/207.2; 15/160

(58) Field of Classification Search ..... 15/207.2, 15/159.1, 160, 167.1, 104.93, 104.94; 132/320; 428/397, 399, 400

See application file for complete search history.

(56) References Cited

U.S. PATENT DOCUMENTS

| | | | | |
|---|---|---|---|---|
| 6,604,531 | B2 * | 8/2003 | Nakamura et al. | 132/200 |
| 6,673,444 | B2 * | 1/2004 | Yuuki et al. | 428/364 |
| 2004/0244809 | A1 * | 12/2004 | Gueret | 132/218 |

FOREIGN PATENT DOCUMENTS

| | | |
|---|---|---|
| JP | 49-47618 | 5/1974 |
| JP | 51-116298 | 10/1976 |
| JP | 2002-058538 | 2/2002 |
| JP | 2003-225123 | 8/2003 |
| JP | 2004-141504 | 5/2004 |

* cited by examiner

*Primary Examiner*—Laura C Guidotti
(74) *Attorney, Agent, or Firm*—Knobbe Martens Olson & Bear LLP

(57) ABSTRACT

A polytrimethylene terephthalate (PTT) brush bristle material has irregularities of 1 to 12 μm formed in its tapered section and offers flexibility and high powder-cosmetic trapping property equivalent to those of natural animal hairs.

13 Claims, 3 Drawing Sheets

BRUSH BRISTLE MATERIAL

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1. Field of the Invention

The present invention generally relates to a brush bristle material mainly made of polytrimethylene terephthalate (PTT) and offering excellent properties to trap and release cosmetics and medicaments, and a cosmetic brush or toothbrush using the same.

More specifically, the present invention relates to a brush bristle material comprising a monofilament made of PTT and having a tapered surface at the tip of the brush hair where irregularities of 1 to 20 μm are formed at intervals of 5 to 50 μm, and a cosmetic brush or toothbrush using the same.

2. Description of Related Art Including Information Disclosed Under 37 CFR 1.97 and 1.98

Synthetic fiber brushes with a tapered end are already known (Patent Literature 1 indicated below), and a number of improvement technologies have been presented to date. Examples include: a multi-step alkali processing performed after a bundle of polyethylene terephthalate (PET) fibers is dipped in a 20 weight-percent sodium hydroxide solution by around 10 mm, neutralized and then washed in order to create a sharp tip (Patent Literature 2); a tapered hair material made by spinning PTT and PET or PBT (polybutylene terephthalate) together, and then dipping the obtained monofilament hair material in a sodium hydroxide solution to have one end tapered and provide moisture absorption property, elasticity and flexibility (Patent Literature 3); and a brush bristle material made of a PET monofilament having a multi-lobed irregular cross-section, wherein one end of the hair is sharpened using a sodium hydroxide solution (Patent Literature 4). However, none of these technologies offered satisfactory properties in terms of trapping and releasing of cosmetics. Also, the hydrolysis time required for PTT is three times the time required for PBT, or even longer. Because of this difficulty to hydrolyze, PTT requires a higher cost to form into a tapered shape, even when sodium hydroxide solution is used, and has therefore been considered uneconomical.

As mentioned above, brush bristle materials comprising PET or PBT monofilaments with one longitudinal end tapered via alkali processing offer flexible tips and are replacing animal hairs as brush materials.

However, because these monofilaments have their surface smoothened by alkali processing, they offer lower powder-cosmetic trapping property compared with animal hairs having scaled surface.

Meanwhile, natural animal hairs are becoming more and more difficult to obtain as the world is growing more conscious of environmental protection issues. Accordingly, use of hair materials made of synthetic fibers is expected to grow further. However, it is difficult for these synthetic fibers to become primary materials for cosmetic brushes unless the aforementioned problems are resolved.

Addition of crimps to brush bristle materials is a known technology. An example of such technology is found in Patent Literature 5 (Japanese Patent Laid-open No. 2003-225123). This technology proposes crimps having a thickness of 5 to 30 times the thickness of the fiber and a height of 1.2 times or less the thickness of the fiber. If crimps become larger, the shape recoverability of the brush bristle material after application and removal of external forces drops, thereby affecting the brush function.

[Patent Literature 1] Japanese Patent Laid-open No. Sho 49-047618

[Patent Literature 2] Japanese Patent Laid-open No. Sho 51-116298

[Patent Literature 3] Japanese Patent Laid-open No. 2004-141504

[Patent Literature 4] Japanese Patent Laid-open No. 2002-058538

[Patent Literature 5] Japanese Patent Laid-open No. 2003-225123

BRIEF SUMMARY OF THE INVENTION

As mentioned above, brush bristle materials made of synthetic fibers and having flexibility and liquid trapping property equivalent to those of natural animal hairs are being sought.

To address this need, an object of the present invention is to provide a brush bristle material, especially a hair material for cosmetic brushes or toothbrushes, which is made of PTT and has a tapered surface with irregularities equivalent to those of natural animal hairs and thus effectively traps powder cosmetics and medicaments.

In an aspect, the present invention was achieved by forming a tapered shape on one end of a monofilament made of synthetic fiber, and providing fine irregularities on the tapered surface to allow powder cosmetic material to be held in the concaved parts, in order to obtain a brush bristle material made of synthetic fiber that offers properties equivalent to those of natural brush bristle materials. The inventors selected PTT monofilament as the base material for this synthetic fiber.

The PTT brush bristle material according to an embodiment of the present invention can be used on brush products that are normally made with natural animal hairs, and is particularly useful on cosmetic brushes and toothbrushes.

Specifically, in preferred embodiments, the present invention is based on the following structures:

(1) A brush bristle material having a tapered section in the tip direction, wherein the brush bristle material comprises a monofilament made of polytrimethylene terephthalate (PTT) having irregularities of 1 to 20 μm formed over the surface of the tapered section.

(2) A brush bristle material described in (1), wherein formation of the irregularities of 1 to 20 μm over the entire surface of the tapered section of the monofilament enhances trapping of powder cosmetics, and a tip of the tapered section has flexibility and strength derived from the rubber-like elasticity of PTT to prevent breaking or severing at the concaved parts of the irregularities while in use and offers excellent shape recoverability due to the rubber-like elasticity of PTT.

(3) A brush bristle material described in (1) or (2), wherein the tapered section of the monofilament is 10 to 20 mm long and crimp shapes are formed with a crimp length of 40 to 50 times the thickness of the monofilament and a crimp height of 3 to 6 times the thickness of the monofilament.

(4) A brush bristle material described in (1), (2) or (3), wherein the irregularities of 1 to 20 μm formed at the tapered section are provided on one end or both ends in the longitudinal direction of the PTT monofilament.

(5) A brush bristle material described in (1), (2), (3) or (4), wherein the PTT is a material made entirely of PTT or containing at least 20% of PTT with respect to PET and/or PBT.

(6) A method of producing the brush bristle material described in (1), (2), (3), (4) or (5), by dipping one end or both ends in the longitudinal direction of a bundle of PTT monofilaments having a length of 20 to 80 mm in an alkaline processing solution and processing it for one to two hours at 110 to 130° C.

(7) A method of producing the brush bristle material described in (6), wherein the bundle is further processed using a heated aqueous solution of benzyl ammonium chloride compound and naphthoquinone compound to add antibacterial property.

(8) A cosmetic brush or toothbrush using the brush bristle material produced by the method described in (6) or (7).

In the above, the degree of the taper of the tip section may vary, and in an embodiment, the tip section may not be tapered substantially. Further, in an embodiment, the irregularities may be formed in a part of the tapered surface. Further, the size of irregularities, 1-20 μm, are intended to mean a majority size range in an embodiment or an average or median size range in another embodiment.

The brush bristle material according to an embodiment of the present invention has a tapered section at its tip in the longitudinal direction by hydrolyzing the tip of a PTT monofilament by alkali with amine catalyst, and fine irregularities of 1 to 20 μm are formed on the tapered surface as a result of partial promotion of hydrolysis.

The obtained brush bristle material has flexibility equivalent to that of natural animal hairs, offers excellent powder trapping and releasing properties, and is therefore most effectively used on cosmetic brushes and toothbrushes.

The brush bristle material according to an embodiment of the present invention provides favorable trapping property particularly for powder cosmetics and other powders. For other paste or liquid cosmetics and medicaments, however, this brush bristle material also provides excellent trapping property equivalent to that of natural hairs and conventional brush bristle materials made of PET and PBT.

The intervals of fine irregularities formed at the tapered section vary depending on the amounts of amine catalyst and emulsifier added. By adjusting the amounts of these additives, irregularities having appropriate intervals can be formed.

The brush bristle material according to an embodiment of the present invention may comprise a monofilament made of PTT mixed with PET and/or PBT, with the PTT content adjusted to 20 percent by weight or more, or more preferably 50 percent by weight or more. Most preferably, the PTT content may be 100 percent by weight.

In all of the aforesaid embodiments, any element used in an embodiment can interchangeably be used in another embodiment unless such a replacement is not feasible or causes adverse effect. Further, the present invention can equally be applied to products and methods.

For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE SEVERAL VIEWS OF THE DRAWING(S)

These and other features of this invention will now be described with reference to the drawings of preferred embodiments which are intended to illustrate and not to limit the invention. The drawings are oversimplified for illustrative purposes.

DETAILED DESCRIPTION OF THE INVENTION

The present invention will be explained with respect to preferred embodiments. However, the present invention is not limited to the preferred embodiments.

As mentioned above, alkali processing has been know as a way to taper polyester monofilaments such as those made of PET, PBT, etc. Compared to other polyesters such as PET and PBT, PTT is slower to hydrolyze under alkali and is therefore considered not suitable for tapering. Hydrolysis of PTT progresses gradually as the alkali processing temperature rises. However, PTT dissolves under severe conditions, which makes it difficult to adjust the tapering conditions.

Crimps with fine irregularities could not be formed easily at the tip of a PET or PBT monofilament, because conventional hair materials made of PET and PBT hydrolyze quickly and are hard and brittle and therefore easily break or sever at the concaved parts of the irregularities.

Figure 3:
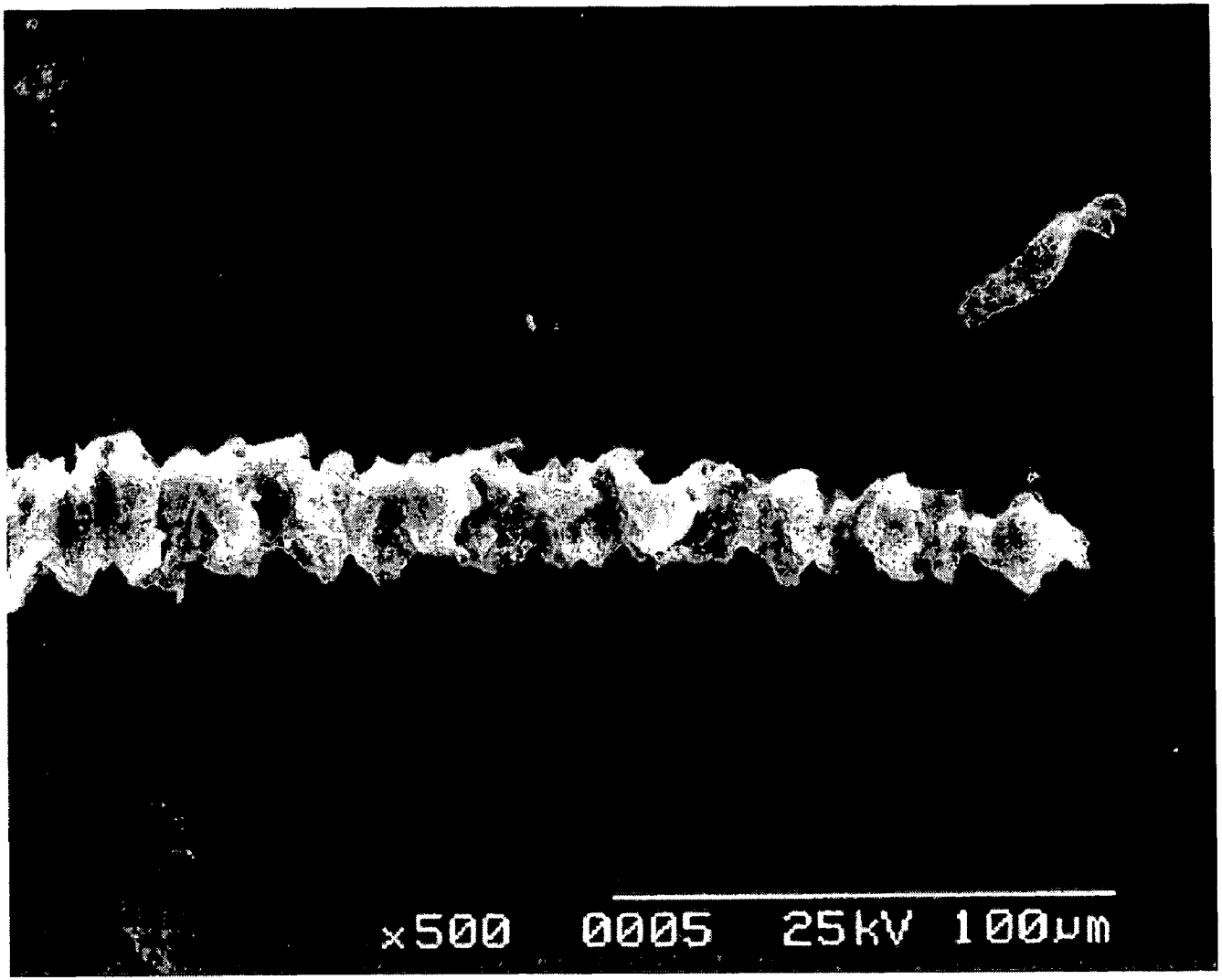
FIG. 3 is a photograph (magnification: ×500) showing the tapered section at the tip of the brush hair obtained in Example 1.
Figure 4:
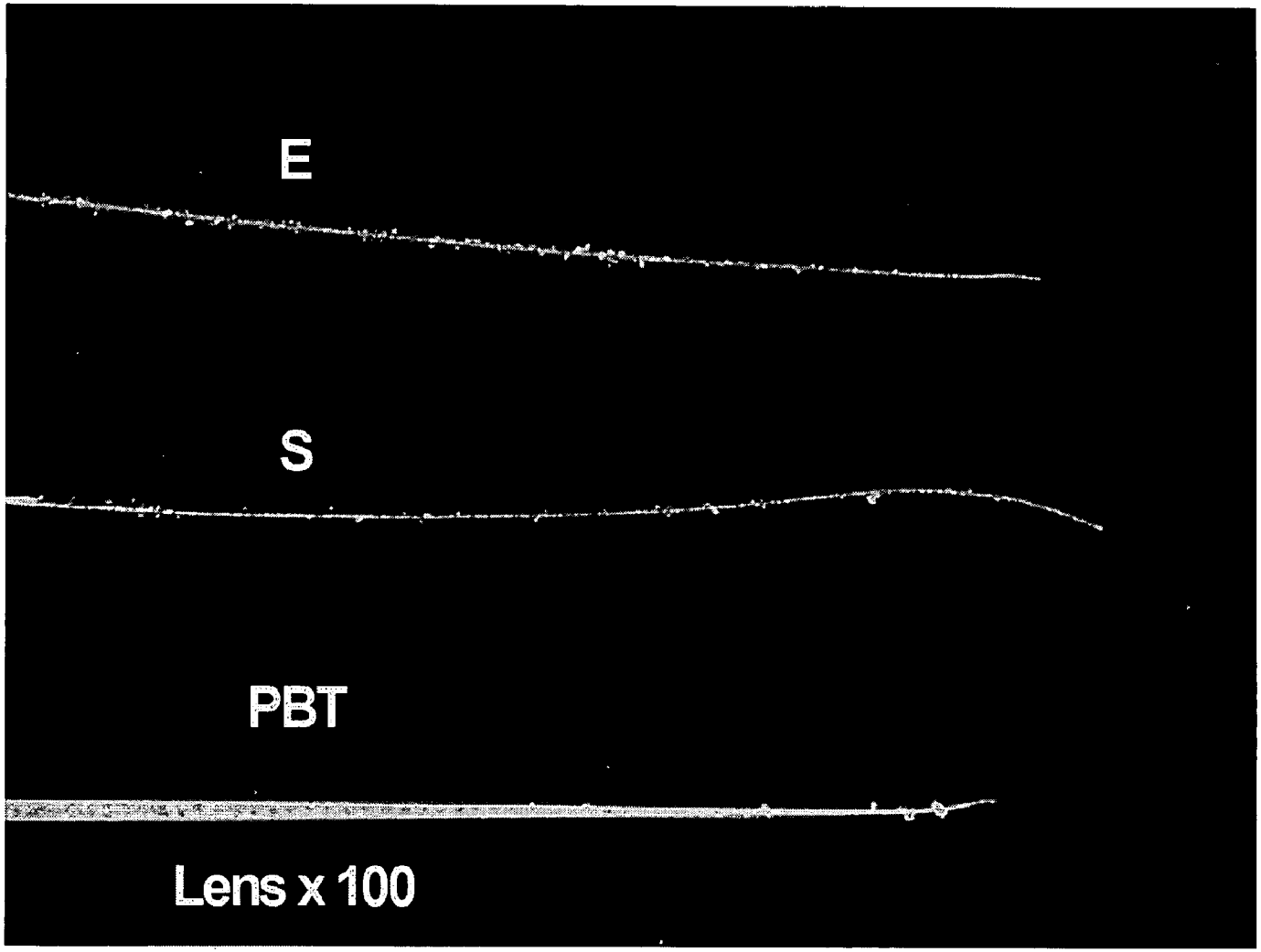
FIG. 4 is a photograph (magnification: ×90) showing a brush bristle material of an embodiment of the present invention, squirrel hair and PBT brush bristle material on which powder cosmetic is trapped.

In any attempt to form crimps with irregularities at the tapered tip of a PET or PBT monofilament, the size shown in FIG. 4 (magnification: ×90) was the finest that could be obtained. The fine irregularities conforming to an embodiment of the present invention and fit for the proposed applications of an embodiment of the present invention could not be formed without breaking or severing the monofilament (this is why it has been impossible to take enlarged photographs of conventional hair materials made of PET and PBT at the same magnification as the photograph shown in FIG. 3).

Also, conventional hair materials made of PET and PBT are hard and therefore often allow cosmetic powders to scatter. In an aspect, the present invention also resolved this problem.

The basic principle of the present invention in an embodiment is to alkali-process PTT, the base material, at high temperature using amine catalyst, thereby accelerating hydrolysis partially to form a tapered shape, while allowing irregularities of 1 to 20 μm to form on the tapered surface. The intervals of fine irregularities thus formed at the tapered section vary depending on the amounts of amine catalyst and emulsifier added. Through adjustments, irregularities can be provided over the entire surface at intervals of 5 to 20 μm.

In other words, in an embodiment, the present invention enables formation of irregularities of 1 to 20 μm at intervals of around 5 to 50 μm on the surface of a tapered section by utilizing the rubber-like elasticity of flexible PTT material, as shown in the electron micrograph given in FIG. 3 (magnification: ×500). A brush made with the obtained brush bristle material can resolve the problem of scattering cosmetic powder.

According to an embodiment of the present invention, PTT is alkali-processed in the same manner as in the conventional technologies. However, in an embodiment, the present invention uses an alkali processing solution comprising sodium hydroxide, hydrolysis accelerator catalyst, penetrant and olygomer solubilizer. A section of around 10 to 20 mm on one end or both ends in the longitudinal direction of a bundle of PTT monofilaments having a length of approx. 20 to 80 mm is dipped in this solution and processed for one to two hours at 110 to 130° C. to obtain an intended brush bristle material having fine irregularities of 1 to 20 μm at intervals of 5 to 50 μm over the surface of the tapered section.

It is also appropriate to add, after the aforementioned alkali processing, a post treatment using a heated aqueous solution of benzyl ammonium chloride compound and naphthoquinone compound to enhance the antibacterial property of the resulting hair material.

When the shape recovery ratio from a 20% elongated state was compared among materials used to produce brush bristle materials according to an embodiment of the present invention, PET exhibited a shape recovery ratio of 29%, while PTT had a very high shape recovery ratio of 88%. The modulus of elasticity of PET was 97 cN/Dtex, while that of PTT was 23 cN/Dtex.

According to an embodiment of the present invention, since PTT material offers excellent flexibility, and also due to the tapering process of PTT as mentioned above, the brush hair made of PTT does not irritate the skin unlike conventional brush hairs made of PET and PBT. Indeed, PTT is flexible, has excellent touch, and offers high shape recoverability and excellent coatability of cosmetics.

The brush bristle material according to an embodiment of the present invention offers a better powder trapping property for medicaments and cosmetics than squirrel hair, which has been rated as offering the best powder trapping property among all brush bristle materials. This is attributable to the many irregularities formed on the material. The brush bristle material according to an embodiment of the present invention offers much better flexibility and touch compared with conventional PET and PBT.

As shown by the electron micrographs given in FIG. 4, the powder-cosmetic trapping property of the brush bristle material according to an embodiment of the present invention is notably higher than the trapping property of squirrel hair, which has been rated as offering the best powder trapping property among all brush bristle materials, or the trapping property of fiber made of PBT belonging to the same polyester group.

According to an embodiment of the present invention, when a PTT monofilament is alkali-processed by applying amine catalyst at high temperature, hydrolysis is partially accelerated and irregularities of 1 to 20 μm are formed on the tapered surface of the monofilament. The intervals of the resulting fine irregularities vary depending on the amounts of amine catalyst and emulsifier added. Through adjustment, these irregularities can be provided over the entire surface of the monofilament's tapered section at intervals of 5 to 20 μm. These fine irregularities enhance the trapping property for cosmetic powders and medicaments comprising finer grains.

Meanwhile, adding crimps to synthetic fiber monofilaments used for brush bristle materials is a known technique. In general, crimped brush bristle materials had a crimp length of 5 to 30 times the thickness of the monofilament and a crimp height of 1.2 times or less the thickness of the monofilament. If larger crimps were formed, the shape recoverability of the brush bristle material after application and removal of external forces dropped, thereby affecting the brush function.

On the other hand, the brush bristle material according to an embodiment of the present invention has a crimp length of 40 to 50 times the thickness of the monofilament and a crimp height of 3 to 6 times the thickness of the monofilament. Formation of fine irregularities despite such a large crimp size becomes possible because of the excellent shape recoverability achieved by the rubber-like elasticity of PTT that comprises the new brush bristle material. It has been revealed that adding crimps of the above shape would increase the void ratio between adjacent brush hairs and increase the amount of powder cosmetic material trapped between the hairs, thereby allowing the cosmetic material to be applied more effectively.

According to an embodiment of the present invention, the heated gear method or hot roll method can be used to easily form on a PTT monofilament comprising the brush bristle material a series of crimps having lengths and heights appropriate for the thickness of the monofilament.

If brush hairs are straight over their entire length, less amounts of powder cosmetic material or other intended substance are held between adjacent brush hairs. By adding crimps with a length of 40 to 50 times the thickness of the monofilament, or around one to three crimps per 2 cm, in the longitudinal direction, the trapping amount of cosmetic material can be increased over the levels achieved with brush hairs having irregularities only.

However, adding more than three crimps per 2 cm reduces the resilience and firmness of brush hairs. A brush having such floppy hairs is difficult to use.

According to an embodiment of the present invention, fine irregularities are formed on the entire tapered surface by alkali-processing PTT with amine catalyst at a high temperature of approx. 120° C. It is difficult to achieve such irregularities with PET or PBT.

The amine catalyst for alkali hydrolysis used in the processing of brush bristle material according to an embodiment of the present invention may be ethyl benzalkonium chloride, lauryl dimethylbenzyl ammonium chloride, cetyl dimethylbenzyl ammonium chloride, dodecyl dibenzyldimethyl ammonium chloride, ethylamine, isopropylamine, triethylamine, ethanolamine, pyrrole or pyridin.

According to an embodiment of the present invention, it is not necessary for all brush hairs comprising a cosmetic brush or toothbrush to have crimps. For example, only 50 to 70% of all hairs can have crimps. The thickness of PTT monofilament may be 60 to 200 decitex, or more preferably 70 to 120 decitex. However, monofilaments of different finenesses can be obtained under different alkali processing conditions. In this case, monofilaments of different finenesses can be mixed during the production process of brush bristle materials.

As for the PTT fiber usable in the present invention, general-purpose monofilaments of 70 to 200 decitex (PTT fiber manufactured by Solotex) can be used. Since cosmetic brushes require antiseptic property, it is appropriate to use monofilaments that have been processed by a heated aqueous solution of benzyl ammonium chloride compound and naphthoquinone compound.

The benzyl ammonium chloride compound used in this process is ethyl benzalkonium chloride, lauryl dimethylbenzyl ammonium chloride, cetyl dimethylbenzyl ammonium chloride or dodecyl benzyl dimethylbenzyl ammonium chloride. As for the naphthoquinone compound, 1,4-naphthoquinone, 2-hydroxy-3-chloronaphthoquinone, 2,3-dichloro-1,4-naphthoquinone, 2-alkoxy-3-chloronaphthoquinone, naphtho[2,3D]thiazole-4,9-dione or 2-alkyl-2,3-thiazole-4,9-dione can be used.

When processing PTT fiber using a heated aqueous solution of the two compounds specified above, it is appropriate to add a carrier agent such as benzoic acid or parahydroxy methyl benzoate. To enhance the adsorption of benzyl ammonium chloride compound and naphthoquinone compound in heated water, it is effective to use a coupling agent such as γ-glycidoxypropyl trimethoxysilane or γ-mercaptopropyl trimethoxysilane.

During the aforementioned processing using a heated aqueous solution, by affixing onto the surface of the hair material one or two or more selected from phospholipid polymer, sericin and chitosan, brush functions can be added such as improved moisture absorption effect, flexibility and strength. This treatment also adds antistatic property, compliance to the skin and smooth touch, thus enhancing the safety of the brush on the skin.

One characteristic of the present invention in an embodiment is that no binder is used to affix the above components onto the PTT hair material, by using hot-water absorption method instead.

Examples of the present invention are explained using drawings. The examples and drawings are not intended to limit the present invention.

Figure 1:
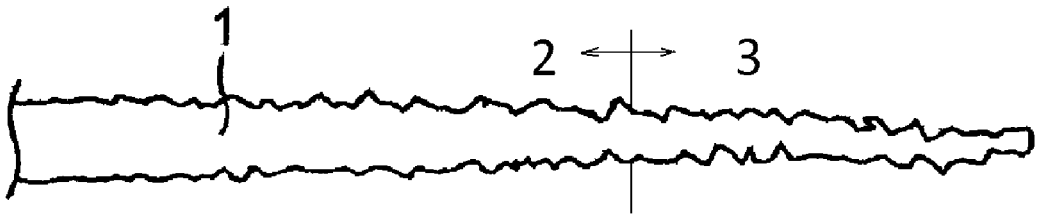
FIG. 1 is a conceptual diagram showing the tapered section with irregularities of a brush bristle material produced according to an embodiment of the present invention.
Figure 2:
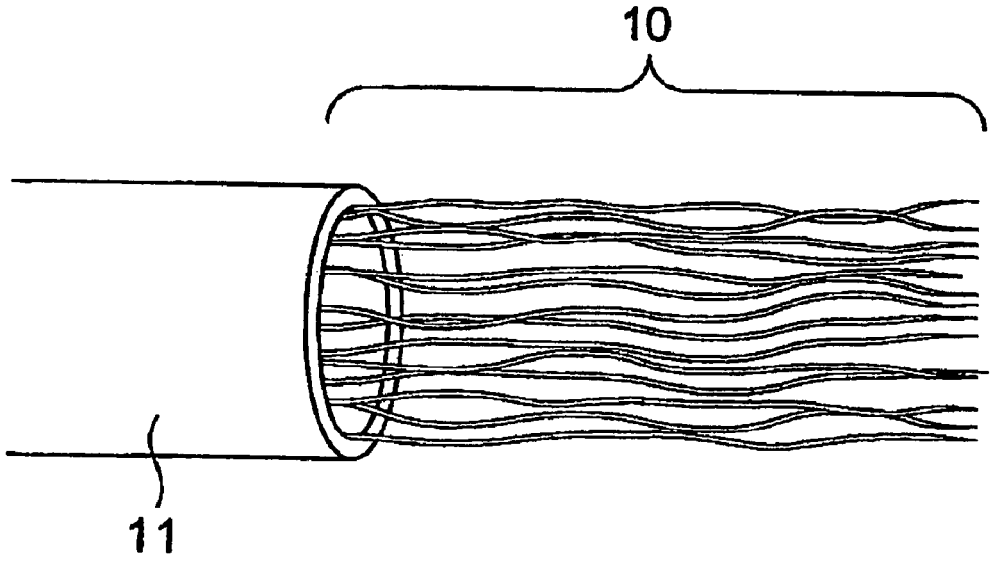
FIG. 2 is a conceptual diagram showing the tip of a brush at which brush bristle materials produced according to an embodiment of the present invention are converged.

FIG. 1 is an enlarged view of the tapered section at the tip of a brush bristle material with irregularities produced according to an embodiment of the present invention. FIG. 2 shows the tip of a cosmetic brush at which brush bristle materials as according to an embodiment of the present invention are converged. FIG. 3 is an electron micrograph of the tapered section at the tip of the brush hair obtained in Example 1. FIG. 4 is comparison photographs showing various brush bristle materials (brush bristle material of an embodiment of the present invention, squirrel hair and PBT brush bristle material) on which powder cosmetic is trapped.

As mentioned above, irregularities of 1 to 20 μm are formed at intervals of 5 to 50 μm at a tip (1) of the brush bristle material (10) according to an embodiment of the present invention, and the irregularities are larger in the section (3) closer to the tip than at the taper base (2). This structure allows cosmetic material to be trapped effectively when this brush bristle material is used for a cosmetic brush. Such a brush provides greater value as it allows more powder cosmetic to be attached compared to other brushes with hairs having irregularities distributed uniformly over the length of the hair.

The brush bristle material (10) is brush hairs according to an embodiment of the present invention, each of which has a tapered section (1) having the aforementioned irregularities (2, 3), and which are converged at the tip of a brush (11), as shown in FIG. 2, and used.

Example 1

Crimps with a length of 45 times the thickness of the fiber and a height of 4 times the thickness of the fiber were added to PTT 80 dtex monofilaments (semi-dull) via the heated gear method to produce a converting bundle of 40 mm in diameter and 50 mm in length (commonly known as "roller"). For the tapering process, a processing solution was prepared by mixing 10 percent by weight of sodium hydroxide, 0.2 percent by weight of DYK-1125 (quaternary ammonium, manufactured by Ipposha Oil Industries) as a hydrolysis accelerator catalyst, 10 percent by weight of Neorate NA-30 (alkyl phosphate, manufactured by Nicca Chemical) as a penetrant, 4 percent by weight of Marpon PS-K (polyhydric alcohol ester, manufactured by Matsumoto Yushi-Seiyaku) as an olygomer solubilizer, and water making up the rest. The aforementioned converting bundle was dipped in this processing solution by 17 mm from the end, and processed for 100 minutes at 120° C., after which the converting bundle was washed, dewatered and dried to produce brush bristle materials having many irregularities of 1 to 20 μm on their tapered surface.

Comparative Example

As a comparative example, a converting bundle of PTT 100 dtex fibers of 4 cm in diameter and 4 cm in length was alkali-processed for 60 minutes at 120° C. using a processing solution that contained only 12 percent by weight of sodium hydroxide without adding ethyl benzalkonium chloride, to produce brush bristle materials.

<Use Test 1>

A cosmetic brush using the brush bristle material of the comparative example was brushed against powdery foundation three times. As a result, 0.001 g of powdery foundation attached to the brush. With a cosmetic brush using the hair material obtained in Example 1, however, the brush picked up 0.002 g of powdery foundation, or twice the amount picked up by the cosmetic brush using the brush bristle material of the comparative example. When the cosmetic brush using the conventional brush material was dipped into a cosmetic lotion, the brush absorbed 0.206 g of the lotion. On the other hand, the cosmetic brush using the material according to an embodiment of the present invention absorbed 0.352 g, or 70% more than the amount absorbed by the conventional material brush.

Example 2

PTT 100 dtex fibers were put together into a converting bundle of 5 cm in diameter and 5 cm in length, and the obtained converting bundle was dipped for 3 cm in a processing solution comprising 16 percent by weight of sodium hydroxide and 0.6 percent by weight of lauryl dimethylbenzyl ammonium chloride, and processed for 70 minutes at 120° C., after which the converting bundle was washed, dried and crimped using a hot roll press. Irregularities of 1 to 25 μm were formed on the tapered section at intervals of 5 to 30 μm.

<Use Test 2>

A cosmetic brush using the hair material of the comparative example was brushed against powdery foundation three times. As a result, 0.001 g of powdery foundation attached to the brush. With a cosmetic brush using the hair material according to an embodiment of the present invention, however, the amount of powdery foundation picked up by the brush was 0.002 g. When the cosmetic brush using the conventional brush material was dipped into a cosmetic lotion, the brush absorbed 0.206 g of the lotion. On the other hand, with the cosmetic brush using the material according to an embodiment of the present invention, the amount of cosmetic lotion absorbed by the brush was 0.364 g.

Example 3

Using the hot roll method, crimps with a crimp length of 40 times the thickness of the fiber and a crimp height of 3 times the thickness of the fiber were added to PTT 200 dtex monofilaments to produce a converging bundle of 4 cm in diameter and 3 cm in length.

A processing solution was prepared by mixing 10 percent by weight of sodium hydroxide, 0.4 percent by weight of DYK-1125 (quaternary ammonium) as a hydrolysis accelerator catalyst, 8 percent by weight of Neorate NA-30 as a penetrant, 5 percent by weight of Marpon PS-K as an olygomer solubilizer, and water making up the rest. The aforementioned converging bundle was tied at the center, and the entire converging bundle was dipped in this processing solution and processed for 100 minutes at 130° C. to provide a tapering processing whereby irregularities were formed on both ends of the converging bundle simultaneously. Thereafter, the converging bundle was neutralized, washed and dried to produce tapered brush bristle materials having irregularities on both ends. The obtained hairs were planted in V-shape on a toothbrush handle to produce a toothbrush.

The obtained toothbrush was more flexible and elastic and provided fresher feel compared with a toothbrush made of conventional PBT hair materials. The tapered brush bristle materials having irregularities offered excellent toothpaste trapping property and enhanced the efficiency of brushing teeth. The toothbrush obtained in this example also offered superior cleaning effect and feel in the mouth.

The present application claims priority to Japanese Patent Application No. 2004-307223, filed Oct. 21, 2004, and No. 2005-284857, filed Sep. 29, 2005, the disclosure of which is incorporated herein by reference in their entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

The invention claimed is:

1. A brush bristle material comprising a monofilament comprised of polytrimethylene terephthalate (PTT), said monofilament having a tip section with irregularities of about 1 μm to about 20 μm formed on a surface of the tip section, wherein concave parts of the irregularities are configured at intervals of about 5 μm to about 50 μm to trap powder cosmetic material therein, and the tip section is tapered in a tip direction wherein the irregularities are larger in an area close to a distal end of the tapered section than in an area close to a proximal end of the tapered section.

2. The brush bristle material as claimed in claim 1, wherein the irregularities are formed on the entire surface of the tapered section.

3. The brush bristle material as claimed in claim 1, wherein a tip of the tapered section has flexibility and strength to prevent breaking or severing at concaved parts of the irregularities during use and has shape recoverability.

4. The brush bristle material as claimed in claim 1, wherein the irregularities of about 1 μm to about 20 μm are provided on one end or both ends in a longitudinal direction of the monofilament.

5. The brush bristle material as claimed in claim 1, wherein the monofilament is made of a material which is made entirely of PTT or made of a mixture of PTT and at least PET or PBT wherein PTT is contained in an amount of at least 20% of the at least PET or PBT.

6. The brush bristle material as claimed in claim 1, which has a surface treated with an antibacterial agent.

7. The brush bristle material as claimed in claim 1, wherein the monofilament has a thickness of about 60 decitex to about 200 decitex.

8. The brush bristle material as claimed in claim 7, wherein the monofilament has a thickness of 70 decitex to 120 decitex.

9. A cosmetic brush or toothbrush comprising the brush bristle material of claim 1.

10. The cosmetic brush or toothbrush as claimed in claim 9, which uses brush bristle materials, at least 50% of which are constituted by the brush bristle material.

11. A brush bristle material comprising a monofilament comprised of polytrimethylene terephthalate (PTT), said monofilament having a tip section with irregularities of about 1 μm to about 20 μm formed on a surface of the tip section, wherein the tip section is tapered in a tip direction, and the tapered section of the monofilament has a length of about 10 mm to about 20 mm and has crimp shapes formed with a crimp length of about 40 times to about 50 times the thickness of the monofilament and a crimp height of 3 to 6 times the thickness of the monofilament.

12. A method of producing the brush bristle material of claim 1, comprising:

dipping one end portion or both end portions in a longitudinal direction of a bundle of monofilaments comprised of PTT having a length of about 20 mm to about 80 mm in an alkaline processing solution; and treating the end portion or portions in the alkaline processing solution for one to two hours at about 110° C. to about 130° C.

13. The method as claimed in claim 12, further comprising treating the monofilaments in a heated aqueous solution of benzyl ammonium chloride compound and naphthoquinone compound to render the monofilaments antibacterial.

* * * * *